US010934772B2

(12) United States Patent
Healam et al.

(10) Patent No.: US 10,934,772 B2
(45) Date of Patent: Mar. 2, 2021

(54) SELF-ADJUSTING BOTTOM BAR FOR A RETRACTABLE SCREEN

(71) Applicant: TUCSON ROLLING SHUTTERS, INC., Tucson, AZ (US)

(72) Inventors: Jeffery L. Healam, Tucson, AZ (US); J. Martin Ackerman, Tucson, AZ (US); Don Zimprich, Tucson, AZ (US); Christophe R. Trafton, Tucson, AZ (US)

(73) Assignee: Tucson Rolling Shutters, Inc., Tucson, AZ (US)

( * ) Notice: Subject to any disclaimer, the term of this patent is extended or adjusted under 35 U.S.C. 154(b) by 293 days.

(21) Appl. No.: 15/898,880

(22) Filed: Feb. 19, 2018

(65) Prior Publication Data

US 2019/0257148 A1 Aug. 22, 2019

(51) Int. Cl.
*E06B 9/54* (2006.01)
*E06B 9/17* (2006.01)

(52) U.S. Cl.
CPC ..... *E06B 9/54* (2013.01); *E06B 9/17046* (2013.01)

(58) Field of Classification Search
CPC .... E06B 9/17046; E06B 9/17076; E06B 9/08; E06B 9/11; E06B 9/17; E06B 9/40; E06B 9/42; E06B 7/18; E06B 7/20
USPC ..... 160/41, 120, 349.1
See application file for complete search history.

(56) References Cited

U.S. PATENT DOCUMENTS 35,224 A * 5/1862 Fisher ..... E06B 7/20 49/308
170,029 A * 11/1875 Sustins ..... E06B 7/20 49/306
499,629 A * 6/1893 Ellis ..... E06B 7/20 49/307
649,150 A * 5/1900 Winter ..... E06B 7/20 49/308
839,213 A * 12/1906 Schwartz ..... E06B 7/2316 49/470
902,143 A * 10/1908 Frigone ..... E06B 7/20 49/303
1,311,127 A * 7/1919 Kendrick ..... E06B 7/20 49/307
1,339,775 A * 5/1920 Maxcy ..... E06B 7/20 49/314
1,345,832 A * 7/1920 Campbell ..... E06B 7/20 49/308
1,578,328 A * 3/1926 Lessing ..... E06B 7/20 49/307

(Continued)

*Primary Examiner* — Johnnie A. Shablack
(74) *Attorney, Agent, or Firm* — Quarles & Brady LLP

(57) ABSTRACT

A self-adjusting retractable screen with an adjustable bottom bar assembly is disclosed herein. The adjustable bar assembly comprises a bottom bar assembly, an adjustable arm assembly, and a pivot assembly. The adjustable arm assembly is pivotally engaged with the bottom bar assembly via the pivot assembly, which is disposed in the horizontal center of both the bottom bar assembly and the adjustable arm assembly. During the deployment of the retractable screen, while the bottom bar assembly remains level, one side of the adjustable arm assembly can pivot upwards when the side first contacts a high point of an uneven surface, i.e., floor. When the screen retracts with the adjustable bottom bar assembly off the uneven surface, the adjust arm assembly has means to return itself to a level position.

17 Claims, 10 Drawing Sheets

(56) References Cited

U.S. PATENT DOCUMENTS 1,682,389 A * 8/1928 Ludeke ..... E06B 7/20 49/308
1,731,343 A * 10/1929 William ..... E06B 7/20 49/306
1,781,864 A * 11/1930 Wyatt ..... E06B 7/20 49/308
1,785,431 A * 12/1930 Bailey ..... E06B 7/18 49/306
1,913,285 A * 6/1933 Oliver ..... E06B 7/18 49/303
1,963,882 A * 6/1934 Brennan ..... E06B 7/20 49/309
2,066,188 A * 12/1936 Reese ..... E06B 7/20 49/307
2,171,070 A * 8/1939 Greif ..... E06B 7/20 49/308
2,199,860 A * 5/1940 Rogers ..... E06B 7/20 49/308
2,282,019 A * 5/1942 Balousek ..... E06B 7/20 49/307
2,344,278 A * 3/1944 Balousek ..... E06B 7/20 49/307
2,433,331 A * 12/1947 Beck ..... E06B 7/20 49/310
2,786,244 A * 3/1957 Rapin ..... E06B 7/20 49/312
2,820,261 A * 1/1958 Brown ..... E06B 7/20 49/306
2,848,767 A * 8/1958 Thompson ..... E06B 7/20 49/308
2,870,495 A * 1/1959 Wetzel ..... E06B 7/20 49/309
3,030,674 A * 4/1962 Kapaun ..... E06B 7/20 49/309
3,072,977 A * 1/1963 Burda ..... E06B 7/20 49/307
3,199,155 A * 8/1965 Coleman ..... C08L 23/02 49/309
3,263,366 A * 8/1966 Woloohojian ..... E06B 7/18 49/314
3,418,753 A * 12/1968 Hanson ..... E06B 7/20 49/308
3,453,780 A * 7/1969 Thompson ..... E06B 7/18 49/482.1
3,703,788 A * 11/1972 Rivers ..... E06B 7/20 49/307
3,798,839 A * 3/1974 Kaufman ..... E05D 15/0613 49/127
4,170,846 A * 10/1979 Dumenil ..... E06B 7/20 49/303
4,246,952 A * 1/1981 Helldorfer ..... E06B 3/285 160/271
4,282,919 A * 8/1981 Teno ..... E06B 9/17015 160/23.1
4,283,884 A * 8/1981 Dumenil ..... E06B 7/20 49/307
4,317,480 A * 3/1982 Phelps ..... E06B 9/40 160/23.1
4,320,598 A * 3/1982 Rodak ..... E06B 7/18 49/480.1
4,406,088 A * 9/1983 Berndt, Jr. ..... E06B 7/215 49/309
4,479,330 A * 10/1984 Muller ..... E06B 7/20 49/303
4,519,165 A * 5/1985 Cronenberg ..... E06B 7/215 49/306
4,610,292 A * 9/1986 Hausmann ..... E06B 9/24 160/120
4,703,586 A * 11/1987 Smith ..... E06B 7/20 49/303
4,805,345 A * 2/1989 Ohi ..... E06B 7/215 49/308
4,947,584 A * 8/1990 Wexler ..... E06B 7/215 49/307
5,467,559 A * 11/1995 Owens ..... E06B 7/2316 160/40
5,522,180 A * 6/1996 Adler ..... E06B 7/20 49/307
5,862,851 A * 1/1999 Stoebich ..... A62C 2/10 160/120
5,934,353 A * 8/1999 Buhr ..... E06B 9/581 160/269
6,125,584 A * 10/2000 Sanders ..... E06B 7/215 49/310
6,195,939 B1 * 3/2001 Sowers ..... E06B 7/21 49/307
6,332,294 B1 * 12/2001 Carranza ..... E06B 7/215 49/505
6,622,431 B1 * 9/2003 Simons ..... E06B 7/18 160/40
6,871,448 B1 * 3/2005 Kline ..... E06B 7/28 49/319
7,320,496 B2 * 1/2008 Griffis ..... B60J 5/0497 296/146.1
7,644,539 B2 * 1/2010 Baxter ..... E06B 7/20 49/303
8,016,013 B2 * 9/2011 Horvath ..... E06B 9/54 160/23.1
8,291,960 B2 * 10/2012 Bowman ..... E06B 9/581 160/267.1
8,336,258 B2 * 12/2012 Speyer ..... E06B 7/205 49/303
8,381,448 B2 * 2/2013 Flory ..... E06B 7/215 49/303
8,468,746 B2 * 6/2013 Salerno ..... E05B 65/0021 49/199
8,684,062 B2 * 4/2014 Ng ..... E06B 9/42 160/23.1
8,745,924 B2 * 6/2014 Tshai ..... E06B 7/215 49/303
8,925,250 B2 * 1/2015 Parker ..... E06B 7/215 49/310
8,985,180 B2 * 3/2015 Kondash ..... E05D 15/0621 160/199
9,068,392 B2 * 6/2015 George ..... E06B 3/481
9,382,752 B1 * 7/2016 Zubay ..... E06B 7/18
9,428,955 B2 * 8/2016 Fleischman ..... E06B 9/58
9,453,368 B2 * 9/2016 Burd ..... E06B 7/20
9,574,398 B2 * 2/2017 Zernach ..... H05K 7/1488
2003/0188837 A1 10/2003 Varley et al.
2004/0010973 A1 * 1/2004 Lio ..... E06B 7/20 49/306
2005/0150607 A1 7/2005 Dekker
2006/0249264 A1 11/2006 Lin
2009/0120593 A1 5/2009 Lesperance
2012/0012262 A1 * 1/2012 Santoro ..... E06B 9/42 160/272
2012/0222828 A1 9/2012 Kwak
2014/0311039 A1 * 10/2014 Ardaiz ..... E06B 7/20 49/470
2016/0258211 A1 9/2016 Smith et al.
2018/0283100 A1 * 10/2018 Hall ..... E06B 9/42
2018/0291674 A1 * 10/2018 Dintheer ..... E06B 7/215
2018/0340369 A1 * 11/2018 Goldberg ..... E06B 9/44
2019/0254261 A1 * 8/2019 Volin ..... E06B 11/021
2019/0323286 A1 * 10/2019 Menendez ..... E06B 9/17046

* cited by examiner

SELF-ADJUSTING BOTTOM BAR FOR A RETRACTABLE SCREEN

CROSS REFERENCE TO RELATED APPLICATIONS

None.

TECHNICAL FIELD

The present invention relates to a retractable screen and, more particularly, to a retractable screen having a self-adjusting interface to a tilted floor.

BACKGROUND OF THE INVENTION

Retractable screens are increasingly popular architectural elements in both commercial and residential installations. In addition to being used as insect or solar screens for windows, retractable screens enhance the usability of outdoor spaces such as overhung patios, where they provide shade and insect protection for the patio, and allow the interior of an attached home to be opened to the outside.

Conventionally, a retractable screen includes a sheet of flexible screen material attached to a base bar. The screen is stored above a ceiling, in a rolled configuration. The screen can be lowered into a deployed configuration, typically via a command from a wall switch or a remote control. As the screen is lowered, the weight of the base bar exerts a downward force on the sheet of screen material, which keeps the screen flat as it is lowered into position. At the bottom of its travel, the base bar contacts the floor or window sill, at which point, the screen is in its deployed or lowered position.

Conventionally, the drum on which a retractable screen sheet is stored is mounted in a level position and the screen is mounted such that it is lowered in a plum, perpendicular direction, with its square sides perpendicular to level. This is ensures that the screen, which is necessarily flexible, does not kink or wrinkle during the lowering process, or when it is in its final, deployed state. Instead, the weight of the screen itself provides even downward pressure across the screen during the lowering process. Additionally, the base bar is conventionally installed such that it is also level, and therefore, perpendicular to the edges of the screen and the direction of movement of the screen during lowering. When the base bar engages with the floor or sill, the screen is deployed.

In the event that a retractable screen is installed above a floor or window sill that is not level, challenges can arise. For example, if the lowering motion of the screen is stopped when the base bar first contacts the floor or sill (i.e., the floor or sill's high point), there will be a gap beneath the bottom of the base bar and the floor or sill (hereinafter "floor") as the floor slopes downwardly away from the bottom of the base bar. This is unsightly and permits pests to come into the screened space underneath the base bar. This problem is particularly acute when a retractable screen is installed on a patio, since patios typically use a slightly sloped floor to shed water. Complicating matters is the fact that patio retractable screens tend to be very wide, with installations in excess of 10 feet being common. This can result in substantial floor gaps of one inch or more from end-to-end.

One solution to this problem would be to continue to lowering the screen until the entirety of the base bar sits flush with the floor, but on the level of the floor (i.e., at the floor's inclination angle with level). The problem with this approach is that it will take tension out of the screen on the high side of the floor or sill, causing the screen to wrinkle or buckle. An alternative solution is to mount the base bar to the screen such that the base bar is at the angle of the non-level floor, but this would require precise measurements and adjustments during installation, since the angle of the base bar would have to change for every installation. Moreover, this is impractical since the retractable screen is typically fabricated as a single unit at the factory before being transported to the jobs site. The current conventional solution is to use so-called "cat hair"—an apron on the bottom of the base bar composed of fine, flexible bristles or felt, which fills the gap between the bottom of the base bar and the floor when the base bar's translation is stopped at the point of first contact. This solution is undesirable, however, because "cat hair" is unsightly, gathers dust and debris, and for some substantially uneven floors, "cat hair" aprons of up to an inch or more are required. A solution that seals the retractable screen to the floor, in an aesthetically pleasing manner, but without the need for costly and time consuming adjustments at the installation site would be desirable.

SUMMARY OF THE INVENTION

Embodiments of the disclosure are directed to a retractable screen bottom bar assembly having, itself, an adjustable bottom arm. The adjustable bottom arm protrudes from the hollow bar by a predetermined amount, in one embodiment, by 0.75", and is attached to the base bar via a pivot. In certain embodiments, the pivot point is centrally located laterally on the bottom arm, enabling pivoting displacement of 1.5 inches at either end of the adjustable bottom arm. In certain embodiments, the pivot attachment mechanism comprises a pivot having an aperture in the adjustable bottom arm, which cooperates with a pivot bearing in the hollow bar. In certain embodiments, the aperture is oblong (i.e., non-circular), which allows the adjustable bottom arm to translate a predetermined amount, in one embodiment by a distance of 0.25", with respect to the hollow bar when the adjustable bottom arm engages with a floor. By this arrangement, when a bottom arm assembly according to an embodiment of the invention is lowered, the adjustable bottom arm engages with a "high side" of the floor, and then pivots with respect to the bottom bar, with one side of the adjustable bottom arm being pushed up into a receiving slot in the hollow bar, and the opposite side pivoting down toward the floor. The pivot continues until the bottom arm's bottom surface attains flush engagement with the floor. This provides a sealed engagement between a level bottom bar assembly and a non-level floor, in a visually pleasing, neat manner, without the need for substantial on-site adjustment, or even prior knowledge of the extent or angle to which the floor is off-level.

While the embodiments of the disclosure described below refer to a single adjustable bottom arm pivotably engaged with a hollow bar via a single, centrally located pivot point, this is not a limitation. In alternative embodiments, multiple adjustable bottom arms are provided across the bottom of a single hollow bar, each being attached at a separate pivot point, with the pivot points horizontally spaced across the hollow bar. In some embodiments, 2 adjustable bottom arms are provided. In other embodiments, 3 adjustable bottom arms are provided. In yet other embodiments, 4 adjustable bottom arms are provided. This arrangement allows for a bottom arm to seal to an uneven floor, even where the floor is not monotonic, i.e., has a changing slope, both in terms of its degree and in terms of its sign. In other embodiments, two bottom arms are provided, each of which pivotably engages the bar at the same pivot point, forming a pair of adjustable "wings" usable to match a floor with a "hump".

In other embodiments, a bottom bar assembly includes a mechanism for holding the adjustable arm level while the screen is being raised or lowered. In certain embodiments, this is accomplished by cooperative magnetic assemblies including magnets arranged at the ends of the hollow bar, and at the ends of the adjustable bottom arm. Each of these magnet assemblies magnetically cooperates to cause the adjustable bottom arm to resist pivoting as the assembly is raised or lowered, until the adjustable bottom arm engages with the floor, at which point, the pivoting force caused by the engagement is sufficient to overcome the magnetic force, allowing the arm to pivot. In certain embodiments, the adjustable bottom bar assembly includes a mechanism for pushing the adjustable bottom arm to level when it is not engaged with the floor, so that magnets mounted in the adjustable bottom arm can be magnetically engaged by magnets mounted in the hollow bar.

Thus, in these embodiments, when the bottom bar assembly and a screen attached to the assembly are retracted, when the adjustable bottom arm is no longer engaged with the floor, an internal leveling mechanism exerts a leveling force on the adjustable bottom arm pushing it toward level, at which point the magnetic assemblies engage to hold the hollow bar level for the duration of the retraction. In some embodiments, this leveling mechanism exerts a pushing force on the adjustable bottom arm. In other embodiments, the leveling mechanism exerts a pulling force. In certain embodiments, the leveling mechanism is a cone shaped spring.

Certain embodiments are directed to a method for deploying a retractable screen. The method includes the steps of providing a sheet of flexible screen material, and providing a bottom bar assembly. The bottom bar assembly has a bottom bar with a top side, a bottom side, and a front and back face, and the bottom bar is attached to a bottom edge of the sheet of flexible screen material. The bottom bar assembly also defines a downwardly facing channel having an open end at the bottom bar's bottom side. The method also includes providing an adjustable arm arranged with a top portion within the downwardly facing channel of the bottom bar assembly and a bottom portion extending downwardly past the bottom side of the bottom bar assembly. The adjustable arm is pivotably attached to a pivot point on the bottom bar and may rotate with respect to the bottom bar about the pivot point. The method also includes translating the retractable screen in a downward direction toward a planar surface until a lower edge of the adjustable bar contacts a portion of the planar surface, causing the adjustable arm to pivot with respect to the bottom bar assembly.

Embodiments of the invention have certain advantages. By using an adjustable bottom arm, a retractable screen can be installed on site, with minimal adjustment, over an uneven floor, and obtain a clean-looking mechanical seal with the uneven floor. Additionally, such a seal can be obtained without the use of unsightly measures such as a "cat-hair" apron. Additionally, embodiments of the invention preserve the neat appearance of the screen as it is raised and lowered by providing a mechanism for self-leveling of the adjustable bottom arm when it is not engaged by contact with the floor. Additional advantages will become clear upon consideration of the following detailed description.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

Figure 1A:
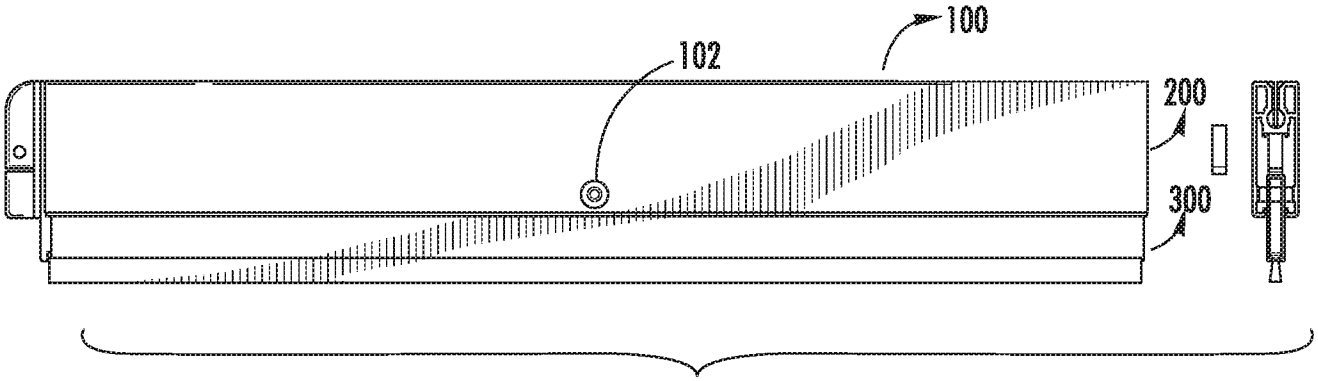
FIG. 1A illustrates an embodiment of a bottom bar assembly for a retractable screen.

The current disclosure describes an apparatus that can be installed on a bottom of a screen to self-adjust when touches a sloped surface. References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment," and similar language throughout this specification may, but do not necessarily, all refer to the same embodiment. It is to be understood that no portion of disclosure, taken on its own and in possible connection with a figure, is intended to provide a complete description of all features of the invention.

In addition, the following disclosure may describe features of the invention with reference to corresponding drawings, in which like numbers represent the same or similar elements wherever possible. In the drawings, the depicted structural elements are generally not to scale, and certain components are enlarged relative to the other components for purposes of emphasis and understanding. It is to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed.

Figure 6:
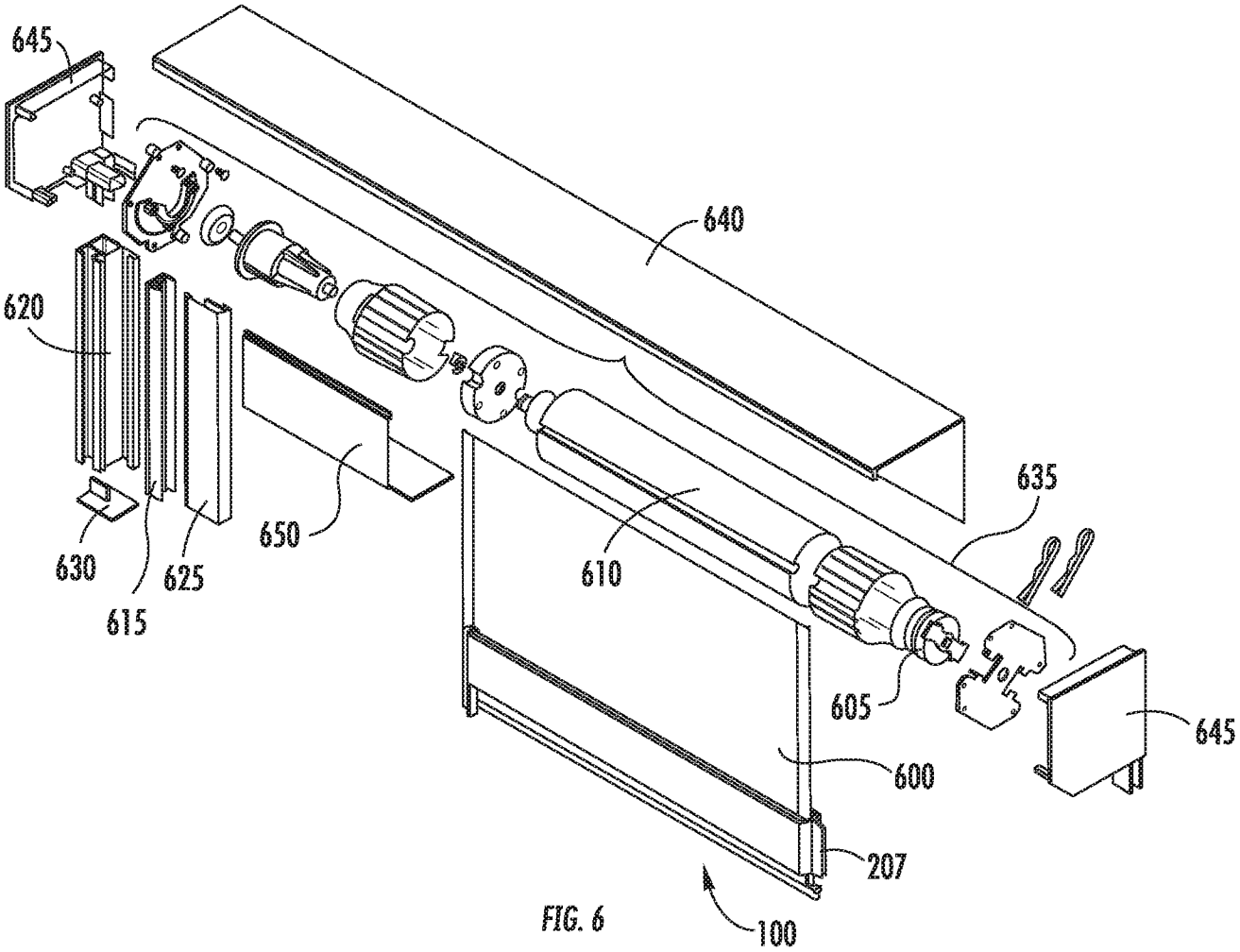
FIG. 6 show an exploded view of a self-adjusting retractable screen assembly including ceiling mounting components.

FIG. 6 shows a retractable screen assembly usable in accordance with certain inventive embodiments. The assembly includes a flexible fabric screen 600 which is deployable from screen storage and drive assembly 635, including a storage drum 610 and drive motor 605. Screen 600 is wound around drum 610 when the screen is retracted. Screen 600 is lowered or raised as drum 610 is rotated by motor 605. Screen storage and drive assembly 635 is typically installed on or above a ceiling or on an interior or exterior wall fascia above an opening to be screened, e.g., a window or patio opening. In installations where screen storage and drive assembly 635 would otherwise be visible, it is concealed with various covers, e.g., back housing 640, end caps 645 and hood 650, which surround and enclose assembly 635, leaving a bottom facing opening or slot through which to lower the screen.

Screen 600 is attached at its lower end to bottom bar assembly 100, which is described in additional detail below. Bottom bar assembly 100 includes end plugs (e.g., 207), each of which has a raised fin which engages and rides in a rail gasket 615. Rail gasket is captured within rail base 620. Rail base 620, rail gasket 615, rail cover 625 and rail plug 630 together comprise a rail assembly that is affixed to a wall defining a window or patio opening. A mutually facing pair of such rail assemblies is used in each retractable screen installation. During the screen lowering process, the engagement between the fins of the bar assembly end plugs and the rail gasket ensures that the screen is lowered in a plum, vertical direction without any deflection or movement due to wind or the like.

Figure 1B:
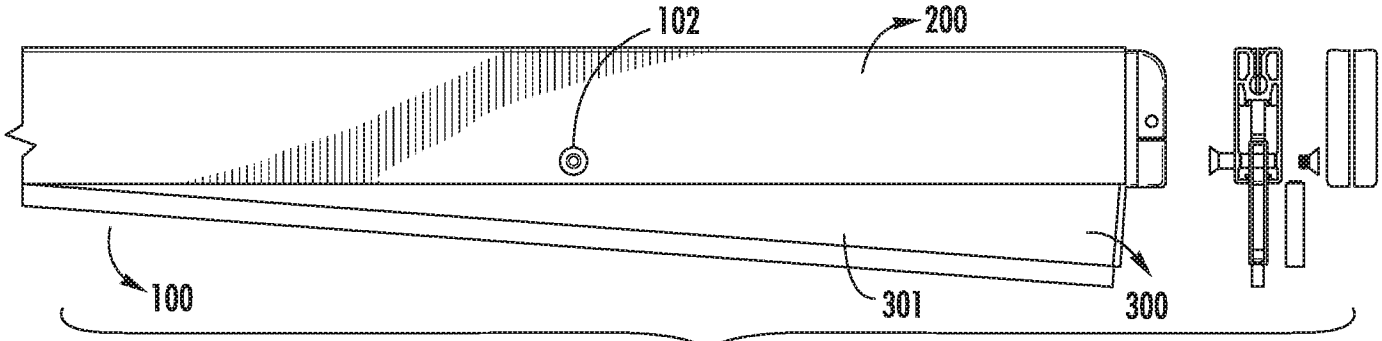
FIG. 1B shows the bottom bar assembly of FIG. 1A when engaged with an uneven floor.

Now referring to FIGS. 1A and 1B, an adjustable bottom bar assembly 100 for a retractable screen assembly is shown. The adjustable bottom bar assembly 100 includes bottom bar assembly 200 and adjustable arm assembly 300. The bottom bar assembly 200 is pivotaby connected to adjustable arm assembly 300 at pivot point 102 via a pivot assembly 400 (FIG. 3) such that an adjustable bottom arm 301 protrudes from a bottom surface of the bottom bar assembly 200 and may pivot about pivot point 102. Thus, as is shown in FIG. 1B, as the adjustable bottom bar assembly 100 is translated in a downward direction, when the adjustable bottom arm 301 of adjustable bottom arm assembly 300 contacts a high point of an uneven plane such as a floor, the entire adjustable bottom arm 301 tilts until it engages the plane of the floor, with a portion of the adjustable arm 301 pivoting up into a receiving channel in the bottom of a bottom bar 201 (FIG. 2), while the other portion the adjustable arm pivots down.

Figure 4:
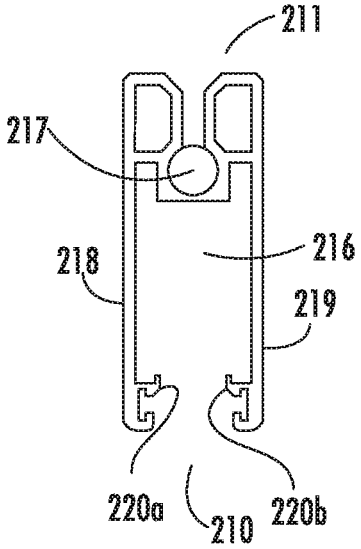
FIG. 4 is a cross sectional view of a hollow bar.

Referring now to FIGS. 1, 4 and 7A-C, an adjustable bottom bar assembly 100 includes subassemblies, bottom bar assembly 200 and adjustable arm assembly 300 described above with respect to FIG. 1. Bottom bar assembly 200 comprises a hollow bar 201, which houses a center pivot block 202, a first magnetic end plug 206, and a second magnetic end plug 207, which are arranged either end of hollow bottom bar 201, and which slot into a central channel 216 defined by hollow bar 201. Further, the hollow bar 201 has an upper end 211 (FIG. 4), an opposing lower end 210 (FIG. 4), and defines a downwardly facing U-shaped central channel 216 (FIGS. 1 and 4). At the upper end 211, the hollow bar 201 defines an upwardly facing channel having a keyhole shaped cross section 217 (FIG. 4). This channel 217 receives a sheet of screen material 600 (FIG. 6), which is attached to hollow bar 201. The hollow bar 201 further defines an aperture 213 (FIGS. 7A and B) in a front face of the hollow bar 201, penetrating a front wall 218 of the hollow bar 201. Hollow bar 201 also includes a set of rails 220 *a,b* (FIG. 4) located on side walls 218, 219 and in a lower portion of downward facing channel 216.

Figure 2:
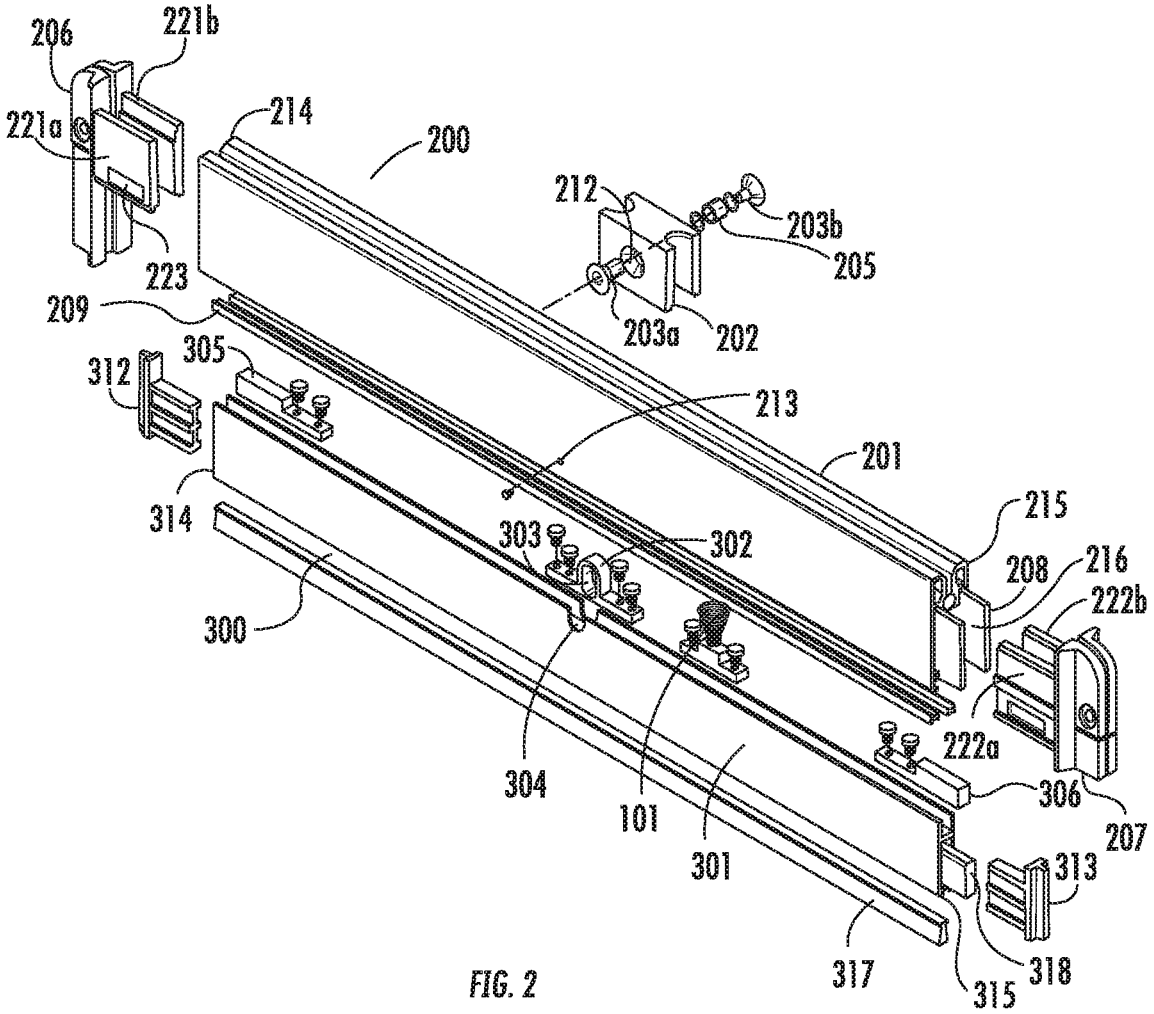
FIG. 2 is an exploded view of the apparatus illustrated in FIG. 1.
Figure 5:
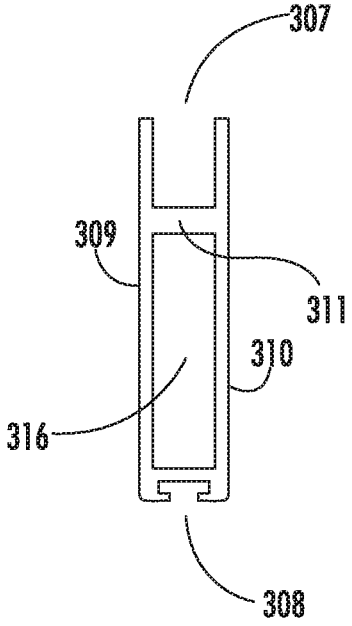
FIG. 5 is a cross sectional view of an adjustable arm.
Figure 7A:
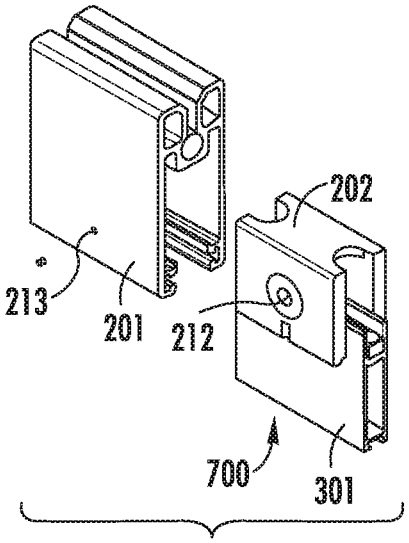
FIG. 7A illustrates a portion of a hollow bar with a center pivot block attached to an adjustable arm.

The operation of the pivoting point of attachment 102 between bottom bar assembly 200 and adjustable arm assembly 300 will now be described in in reference to FIGS. 1, 2-5 and 7A-7C. Referring now to FIG. 5, there is shown a cross section of an adjustable bottom arm 301. Bottom arm 301 defines a square u-shaped upwardly facing channel 307 having a medial divide 311. This upwardly facing channel 307 receives pivot aperture block 302, which rests on medial divide 311 and is attached thereto with fasteners as shown in FIG. 2. Pivot aperture block 302 defines an aperture 303, which is some embodiments is oblong, having a longer vertical dimension than its horizontal dimension. During assembly of the bottom arm assembly 100, pivot aperture block is pivotably pinned to pivot block 202 (FIGS. 2 and 7*a*). Pivot block 202 defines through-bore 212 (FIG. 2), which penetrates both the front and back walls of pivot block 202. Pivot block 202 is hollow and open to the bottom, and during assembly is slid down and over pivot aperture block 302 until its through bore 212 is aligned with the aperture 303 of pivot aperture block 302. Pivot block 202 is then pivotably pinned to pivot aperture block 302 by the insertion of sleeve bearing 205 into bore 212.

The diameter of sleeve bearing 205 is chosen to be slightly less than the inside diameter of bore 212, such that it is captured within bore 212, but is free to rotate within bore 212. Because of previous alignment of aperture 303 with bore 212, after insertion of sleeve bearing 205, sleeve bearing rests in aperture 303 and thereby rotabably engages pivot aperture block 302. In certain embodiments, sleeve bearing 205 is sufficiently long to engage the bore holes in the front and back walls of pivot block 202, but this is not a requirement. Sleeve bearing 205 is secured to pivot block 202 with pan-head screws 203*a,b*, which engage sleeve bearing 205 (which has an interior threaded bore) from either side as shown. The result is a pivot block assembly 400, in which pivot block 202 is pinned to pivot aperture block 302, and can rotate with respect to pivot aperture block 302 as the bearing sleeve 205 rotates with respect to bearing aperture block 302.

Figure 3:
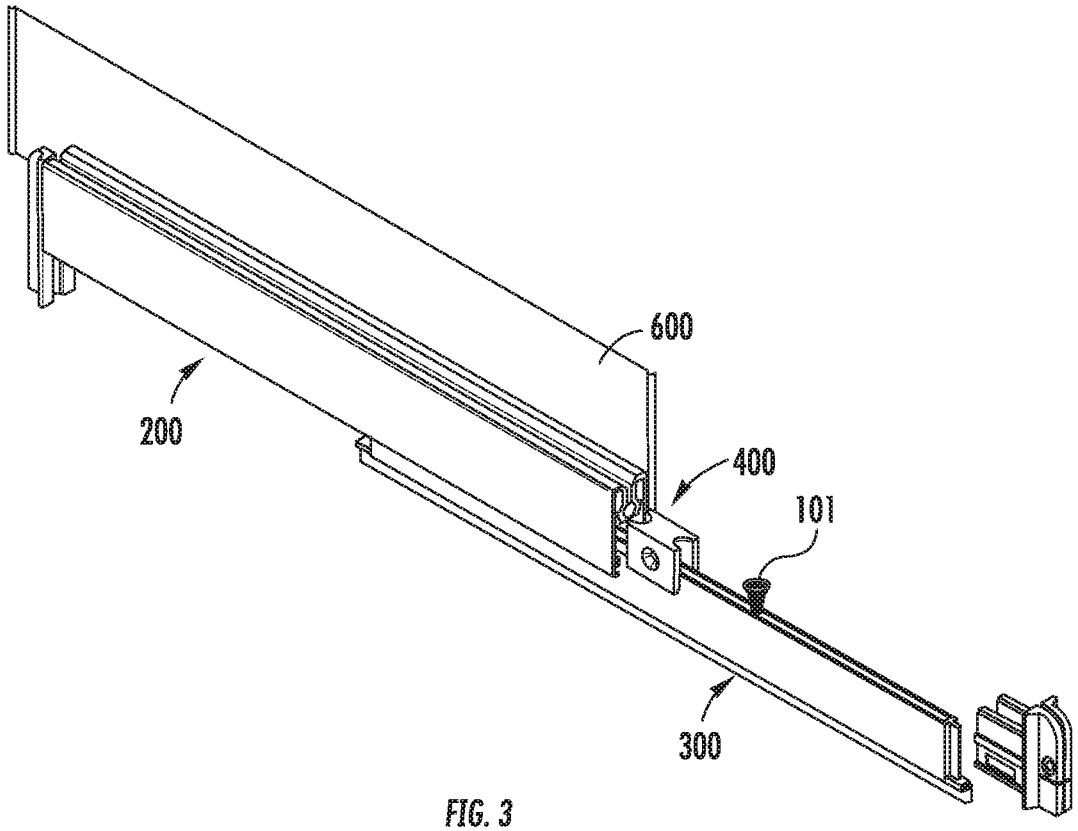
FIG. 3 illustrates a manner of assembly for the adjustable arm and bottom bar of FIGS. 1A, 1B, and 2.
Figure 7B:
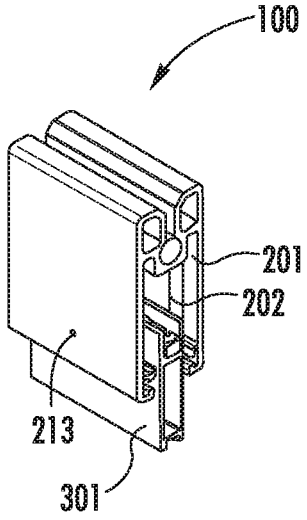
FIG. 7B shows an assembly of a hollow bar, a center pivot block, and an adjustable arm.
Figure 7C:
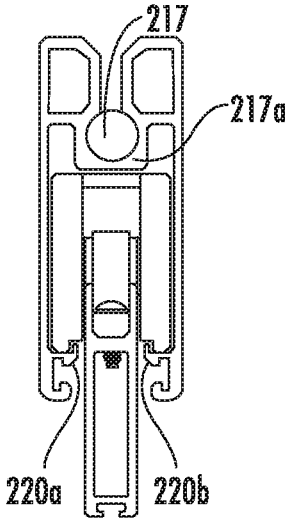
FIG. 7C is a cross sectional view of the assembly illustrated in FIG. 7B.

To complete the assembly of adjustable bottom arm assembly 100, pivot block assembly 400, including pivot block 202, which at this point is attached to pivot aperture block 302 and thereby to adjustable lower arm assembly 301, is slid into channel 216 of hollow bar 201 through one of hollow bar 201's open ends 214 or 215. This process is illustrated in FIGS. 3 and 7A-B. Pivot block 202 is then slid down channel 216, where it engages with rails 220*a,b* (FIG. 4) until it is centered in hollow bar 201. At that point, it is secured to hollow bar by inserting a set screws through aperture 212 (FIG. 2), which engages with pivot block 202. The result of this process is the pivotable attachment of bottom bar assembly 200 to adjustable arm assembly 300 at a central pivot point 102 (FIG. 1).

Figure 9A:
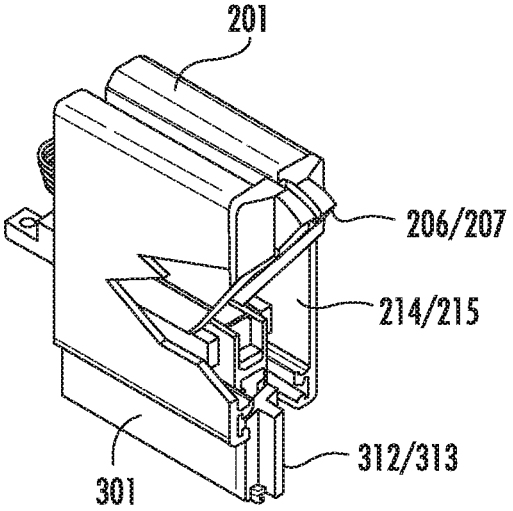
FIG. 9A shows an end of assembled adjustable arm and bottom bar with a magnetic plug and a magnet.

Referring now again to FIG. 2, lower bar assembly 200 includes magnetic plugs 206, 207 each include a pair of inwardly projecting arms 221*a, b*, and 222*a, b* respectively (FIG. 2), and each arm includes a magnet 223, for a total of four magnets associated with the magnet plugs. Referring to FIG. 9A, during assembly, magnetic plug 206 is inserted into the hollow bar 201 from first end 214 of the hollow bar 201 and the second magnetic plug 207 is inserted into the hollow bar 201 from the second end 215. After assembly, now referring to FIG. 9B, the inwardly projecting arms 221*a, b* and 222*a, b* of magnetic plugs 206, 207 lie alongside interior surfaces of channel 216 such that magnets 223 for each pair of arms define a gap between themselves, the center of which is centered in channel 216.

Referring still to FIG. 2, bottom bar assembly 200 also includes a pair of felt strips 209 at hollow bar 201's lower end 210. Felt strips 209 project inwardly into channel 216, and together, serve to center adjustable arm 301 in channel 216. Additionally, the felt strips keep water, dirt, and other debris out of the adjustable bottom bar assembly 100.

In certain embodiments, the bottom bar assembly 200 further comprises metal inserts 208 *a, b, c, d* to add weight. For example, in some embodiments, to one side of channel 217 next to side wall 218 (FIG. 4), two metal inserts 208 *a, b* are inserted into channel 216. Similarly, to the other side of channel 217 next the side wall 219, two metal inserts 208 *c, d* are inserted into channel 216. Each metal insert also fits between center pivot block 202 and a magnetic plug. The metal inserts 208 *a, b, c, d* facilitate the deployment of the sheet of screen material downwardly and when the screen is deployed, the weight of metal inserts 208 *a,b* help the sheet of screen material to stay wrinkle free. Each metal insert 208 is about 1.5 inches tall and about 0.125 inches thick. While specific values chosen for this embodiment are recited, it is to be understood that, within the scope of the invention, the values of all of parameters may vary over wide ranges to suit different applications. As used herein, "about" is used to account for ±10% differences in any measurement.

The adjustable bottom bar assembly of FIG. 2 also includes an adjustable bottom arm assembly 300, which includes adjustable bottom arm 301, a pivot aperture block 302, a first magnet 305, and a second magnet 306. Bottom arm 301 defines a hollow central channel 316 (FIG. 5), an upwardly facing U-shaped channel 307 (FIG. 5), and a downwardly facing U-shaped channel 308 (FIG. 5). Upwardly facing channel 307 is defined, in part, by medial divide 311 (FIG. 5). As is discussed above, pivot aperture block 302 further defines an aperture, 303, which in certain embodiments is elliptical or oval shaped, with a long axis oriented vertically. In other embodiments, aperture 303 is O-shaped. In embodiments where aperture 303 is oblong, bottom arm 301 is free to translate vertical by the extent of the vertical difference between aperture 303 and the outside diameter of sleeve bearing 205. Adjustable arm 301 also defines a bore 304 through adjustable arm, penetrating each of side walls 309, 310 of arm 301. Pivot aperture block 302 is disposed on and fastened to the center of the medial divide 311, in upwardly facing channel 307, such that its aperture 303 is aligned with bore 304. Additionally, magnet 305 is also disposed towards a first end 314 of the arm 301 and fastened to the medial divide 311 in channel 307. The magnet 306 is also disposed towards a second end 315 of the bottom arm 301 and fastened to the medial divide 311 in channel 307. Different ways of removably fastening the center pivot block 302 and magnets 305 and 306 to the medial divide 311 can be used, such as using screws.

In addition, the assembly 300 contains a first arm plug 312, a second arm plug 313, a metal insert 318, and a strip of downwardly facing felt 317. In some embodiments, this felt is about 0.4 inch in height. In other embodiments, the felt is about 1 inch in height. The examples here are not meant to be limiting and the felt 317 may vary in height to suit different applications. The first arm plug 312 is disposed towards the end 314 and inserted into the housing 316. Similarly, the second arm plug 313 is disposed towards the end 315 and inserted into the housing 316. Just like metal inserts are used in assembly 200 to weigh it down, the metal insert 318 is inserted in the housing 316 to weigh down assembly 300 to facilitate deploying the sheet of screen material downwardly and to help deployed screen material stay wrinkle free. In certain embodiments, the metal insert 318 is about 0.25 inches tall and about 0.75 inches thick.

It will be seen that in the assembled system of FIG. 2, and also referring to FIGS. 9A and B, magnets 305, 306 are aligned with and between respective pairs of magnets 223 when adjustable arm assembly 300 is level with respect to bottom bar assembly 200. The polarities of these magnets are chosen such that each magnet pair on hollow bar 201 magnetically engages with one of magnets 305, 306 on bottom arm 301, such that when there is not vertical force applied to bottom arm 301, bottom arm 301 is held in place and is level. Thus, as assembly 100 is lowered, bottom arm 201 remains stable and level with respect to hollow bar 201, and does not swing or pivot in an unsightly manner, despite the vibration and instability introduced by lowering the assembly 100 to the ground. The magnetic engagement, however, does not have sufficient force to resist bottom arm 301 pivoting when it contacts the off-level floor. Thus, when bottom arm 301, or specifically, felt 317, contacts a high point on a floor during its downward movement, it pivots about the pivot point (102 in FIGS. 1A and 1B), until the entire bottom arm 301 is engaging the floor in a flush manner. Therefore, in a case when assembly 100 is level, but floor is off-level, when the screen is deployed, hollow bar 201 will remain level (and the attached screen will not wrinkle or kink), while bottom arm 301 will be inclined at the angle of the floor, providing a flush seal to the floor.

Figure 9B:
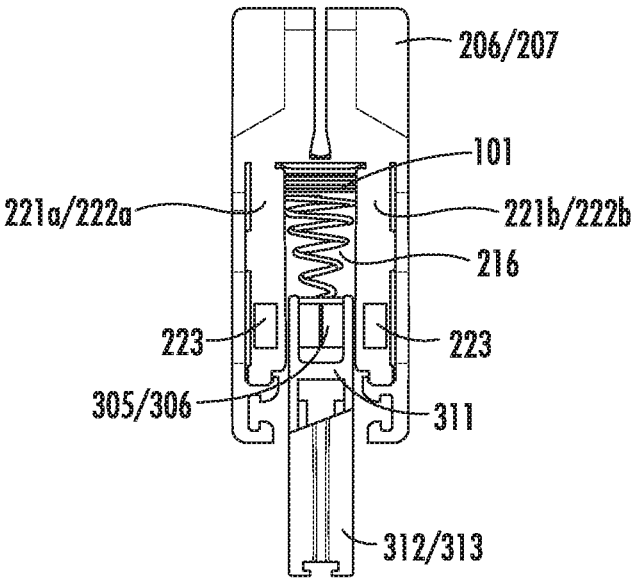
FIG. 9B is a cross sectional view of FIG. 9A.

When assembly 100 is retracted off the floor, bottom arm 301 will have a natural tendency to remain in its inclined position. The engagement between magnets 305, 306, 223 may be sufficiently strong to pull arm 301 level, but this is not a requirement for all embodiments. Certain embodiments include a mechanism for pushing bottom arm 301 level so that the magnets 305, 306 get close enough to magnets 223 for magnetic engagement to occur. Referring now to FIGS. 2, 3 and 9B, a spring 101 is arranged between adjustable arm 301 and bar 201, and is located laterally with respect to pivot assembly 400. In one embodiment, spring 101 is arranged in upwardly facing channel 307 of bottom arm 301, but in alternative embodiments, spring 101 is attached to bar 201 rather than to arm 301. In certain embodiments, spring 101 is affixed to assembly 100 on the side of the assembly where arm 301 pivots up into bar 201 (i.e., on the side of the pivot point 400 where the floor is high). In alternative embodiments, a pair of springs are used, one on each side of picot point 400.

When bottom arm 301 pivots because of engagement with the floor, spring 101 will compress. When assembly 100 is retracted, the compressed spring 101 pushes down on the medial divide 311 (and up on the top surface of channel 216 in bar 201), and exerts downward force on one side of bottom arm 301, which returns it to an approximately level position, at which point it is there captured magnetically by magnets 305, 306, 223. Spring 101 is sized to exert no force between bar 201 and arm 301 when arm 301 is level with respect to bar 201. In certain embodiments, conical springs are used, but other methods are possible and within the scope of the invention. For example, the springs could be leaf springs. A single spring (e.g., a leaf spring) capable exerting no force in a neutral, level position, but capable of both pushing and pulling, depending on the tilt of bottom arm 301 would also be acceptable.

Figure 8:
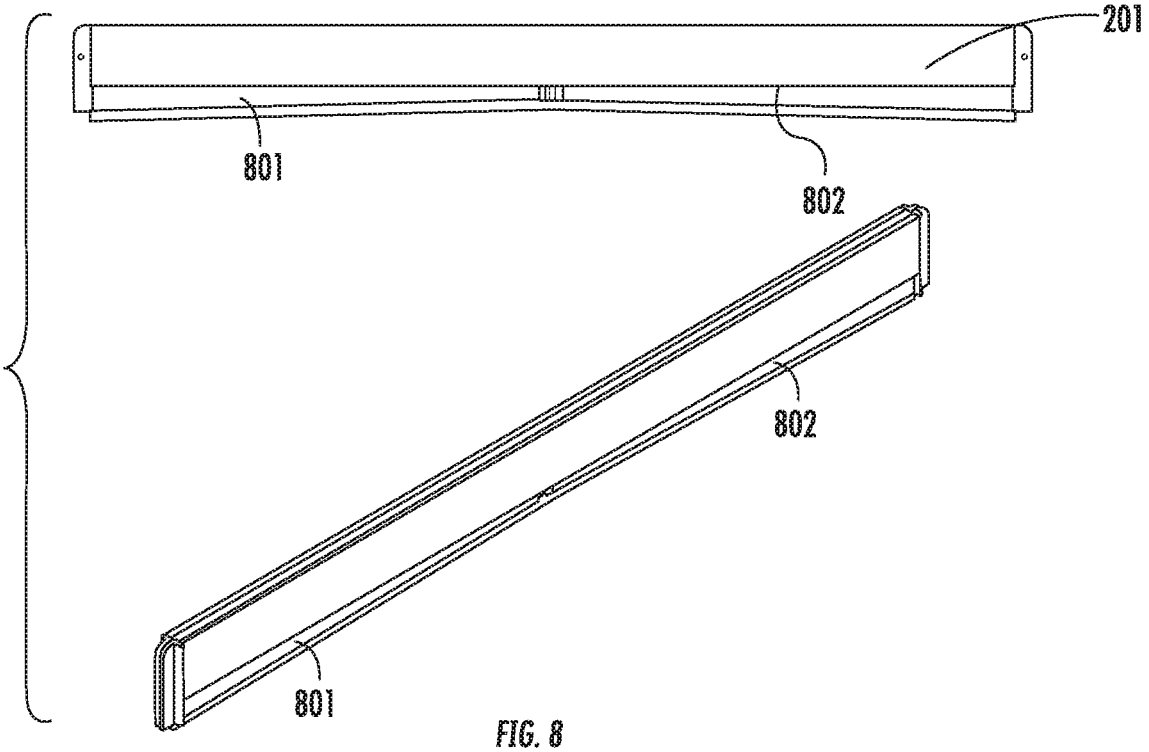
FIG. 8 illustrates a different embodiment of the bottom bar assembly.

Referring to FIG. 8, in certain embodiments, there are multiple adjustable bottom arms 801 and 802, each capable of pivoting, which span the lateral extent of the assembly. In the embodiment of FIG. 8, two adjustable arms 801 and 802 are provided, each of which is attached to a centrally located pivot point, and each of which can pivot from that central point as shown. This embodiment of the adjustable bottom bar assembly 100 allows a flush seal to a floor that has a center high point and slopes downwardly both sides from the center high point. In other embodiments, 3 or more adjustable bottom arms are utilized to allow for a flush engagement between the adjustable bottom bar assembly 100 and a floor that has multiple non-monotonic height variations. In these embodiments, multiple adjustable arms, each pivotably attached to its own pivot, are laterally spaced across the bottom of a bottom arm, forming a segmented linear array of adjustable arms.

Figure 10:
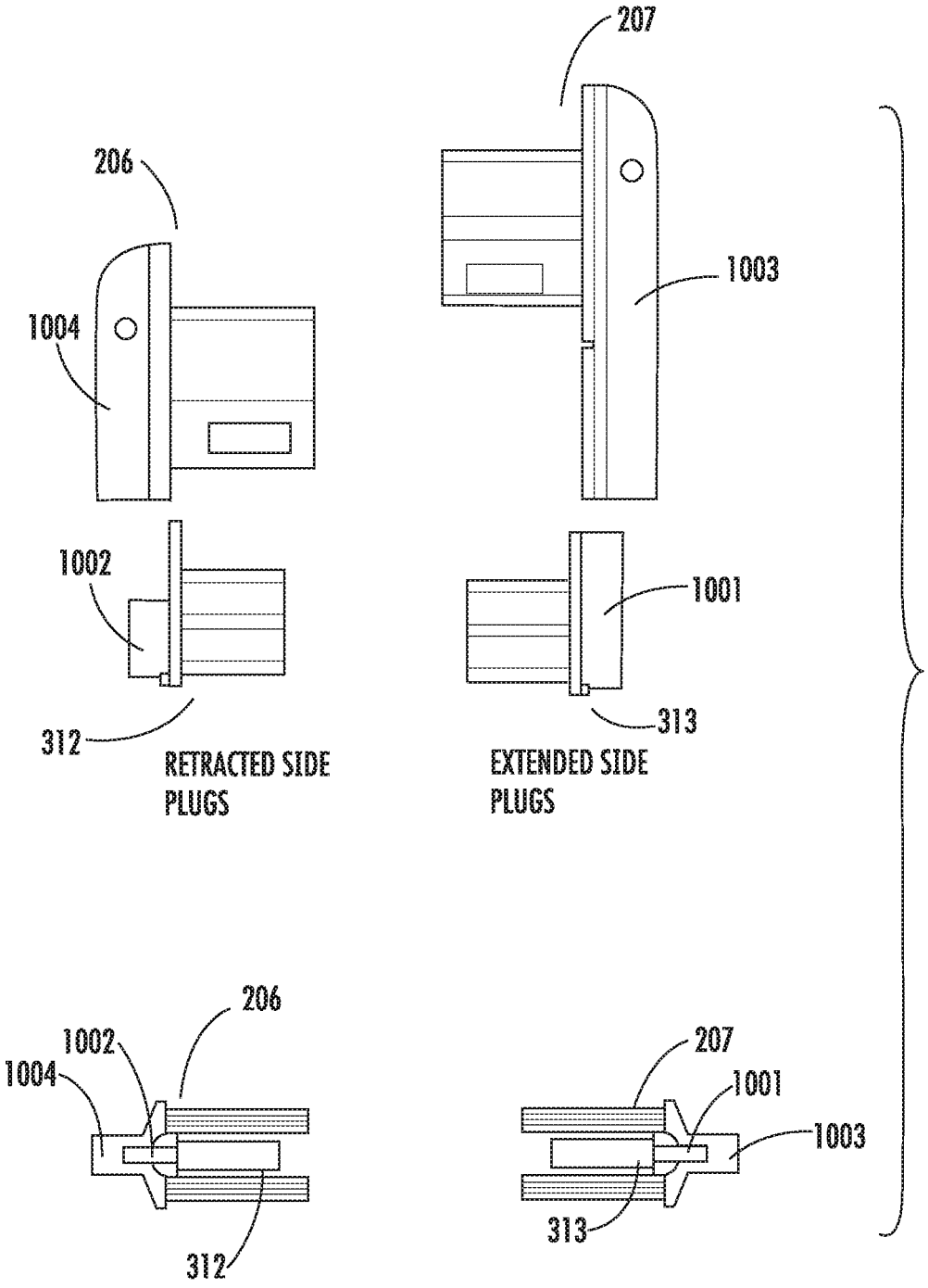
FIG. 10 shows right-and-left specific bar and arm end plugs for certain screen installations.

Referring now to FIG. 10, a particular embodiment's bar and arm end plugs will be described in additional detail. Adjustable arm end plugs 312, 313 have outwardly extending vertical fins 1002, 1001. Likewise, bar end plugs 206, 207 have outwardly extending vertical fins 1004, 1003. Arm fins 1001, 1002 fit into corresponding slots defined in bar end plugs 207, 206 as shown. It will be recognized that clearance issues may arise between the arm end plug fins and arm end plugs as the arm pivots up into the bar on the retracted side, i.e., the side corresponding to the high side of the floor. To account for this, the vertical extent of the arm end plug fin 1002 may be shortened on the retracted side of the assembly. Additionally, on the extended side, where the arm plug fin 1001 pivots down and away from the bar, a gap might be revealed between fin 1001 and plug 207. To account for this, an arm end plug with a longer fin 1001 and a bar end plug with a longer fin 1003 may be provided. During installation, plugs having long fins may be provided, which are then cut down to the appropriate size depending on the extent to which the adjustable arm pivots for a given installation. Alternatively, measurements may be taken on-sight, and appropriate left and right end plugs may be constructed off site for later installation.

While the preferred embodiments of the present invention have been illustrated in detail, it should be apparent that modifications and adaptations to those embodiments may occur to one skilled in the art without departing from the scope of the present invention.

The invention as recited in claims appended to this disclosure is intended to be assessed in light of the disclosure as a whole.

What is claimed is:

1. A self-adjusting retractable screen assembly, comprising:

a sheet of flexible screen material;

a bottom bar assembly comprising a bottom bar having a top side, a bottom side, and a front and back face, the bottom bar assembly defining a downwardly facing channel having an open end at the bottom side of the bottom bar, wherein the bottom bar is attached to a bottom edge of the sheet of flexible screen material;

an adjustable arm having a downwardly extending portion below the bottom bar and having a top portion that is within the downwardly facing channel of the bottom bar;

wherein a center of the adjustable arm is pivotably attached to a pivot point on the bottom bar such that the adjustable arm has horizontally extending portions of equal length on two sides of the attachment to the pivot point and the adjustable arm is capable of rotating with respect to the bottom bar about the pivot point; and wherein the bottom bar and the adjustable arm each include magnets arranged to magnetically engage one another when the adjustable arm is in a predetermined position with respect to the bottom bar, and arranged to exert magnetic force between the bottom bar and the adjustable arm to cause the adjustable arm to magnetically resist translation and rotation with respect to the bottom bar.

2. The assembly of claim 1, wherein the adjustable arm includes a first and a second end plugs located at a first and second lateral ends of the adjustable arm, wherein each end plug includes an outwardly extending fin having a vertical extent, and wherein the vertical extent of the first end plug is different than the second end plug.

3. The assembly of claim 1, wherein the bottom bar and the adjustable arm each have first and second ends arranged horizontally, in opposite directions from said pivot point, and wherein the bottom bar and the adjustable arm each have magnets at said first and second ends.

4. The assembly of claim 1, wherein the bottom bar includes a pair of magnets located at one of the first or second ends, the pair of magnets arranged opposite one another on interior surfaces of the front and back faces of the bottom bar.

5. The assembly of claim 1, wherein the bottom bar includes two pairs of magnets located at each of the first and second ends, the pair of magnets arranged opposite one another on interior surfaces of the front and back faces of the bottom bar, and wherein magnets on the bottom bar and adjustable arm are arranged that they are aligned along an axis transverse to the front and back faces of the bottom bar when the adjustable arm is in a horizontal position.

6. The assembly of claim 1, wherein the adjustable arm includes at least one magnet that is received inside of the bottom bar's downwardly facing channel when the adjustable arm is in a predetermined position with respect to the bottom bar.

7. The assembly of claim 1, wherein the bottom bar and the adjustable arm each has first and second ends arranged horizontally, in opposite directions from said pivot point;

the bottom bar includes two pairs of magnets located at each of its first and second ends, the pair of magnets arranged opposite one another on interior surfaces of the front and back faces of the bottom bar;

the adjustable arm includes a magnet at its first end, and another magnet at its second end, each of which is received between and is magnetically engaged by a respective pair of magnets located at each end of the bottom bar when the adjustable arm is in a predetermined pivot position with respect to the bottom bar.

8. The assembly of claim 7, wherein the predetermined pivot position is when a bottom edge of the adjustable arm is substantially parallel to a bottom edge of the bottom bar.

9. The assembly of claim 1, wherein the downwardly facing channel and the adjustable arm are sized to allow a portion of the adjustable arm to pivot up into the downwardly facing channel when a bottom portion of the adjustable arm contacts a non-level surface.

10. The assembly of claim 1, further including a first spring which exerts force between the adjustable arm and the bottom bar sufficient to bring a bottom edge of the adjustable arm level with a bottom edge of the bottom bar when no external pivoting force is acting on the adjustable arm.

11. The assembly of claim 10, further including a second spring which exerts force between the adjustable arm and the bottom bar sufficient to bring a bottom edge of the adjustable arm level with a bottom edge of the bottom bar when no external pivoting force is acting on the adjustable arm, wherein each of the first and second springs is located on opposite sides of the pivot point from one another.

12. The assembly of claim 10, wherein the first spring is a conical spring.

13. The assembly of claim 10, wherein the first spring is sized to exert no force between the adjustable arm and the bottom bar when a bottom surface of the adjustable arm is level with respect to a bottom surface of the bottom bar.

14. The assembly of claim 1, wherein the pivot point comprises a cylindrical bearing attached to the bottom bar.

15. The assembly of claim 14, wherein the adjustable arm includes a pivot block defining an aperture sized to pivotably engage the cylindrical bearing.

16. The assembly of claim 15, wherein the aperture is longer in extent in a vertical direction than in a horizontal direction, allowing the adjustable arm to translate vertically with respect to the bottom bar.

17. A method for deploying a retractable screen, the method comprising:

providing a sheet of flexible screen material;

providing a bottom bar assembly comprising a bottom bar having a top side, a bottom side, and a front and back face, wherein the bottom bar is attached to a bottom edge of the sheet of flexible screen material, the bottom bar assembly defining a downwardly facing channel having an open end at the bottom bar's bottom side;

providing an adjustable arm arranged with a top portion within the downwardly facing channel of the bottom bar assembly and a bottom portion extending downwardly past the bottom side of the bottom bar assembly, wherein the adjustable arm is pivotably attached to a pivot point on the bottom bar and is capable of rotation with respect to the bottom bar about the pivot point;

translating the retractable screen in a downward direction toward a planar surface until a lower edge of the adjustable bar contacts a portion of the planar surface, causing the adjustable arm to pivot with respect to the bottom bar assembly;

translating the retractable screen in an upward direction, exerting a rotational force on the adjustable arm causing it to pivot to a level position, magnetically capturing the adjustable arm in a level position and magnetically maintaining the adjustable arm in said level position as it is translated upward.

* * * * *